US006270047B1

(12) United States Patent
Hudson

(10) Patent No.: US 6,270,047 B1
(45) Date of Patent: Aug. 7, 2001

(54) KEYBOARD TILT MECHANISM

(75) Inventor: Randy Hudson, Cambridge (CA)

(73) Assignee: CompX International Inc., Mauldin, SC (US)

( * ) Notice: Subject to any disclaimer, the term of this patent is extended or adjusted under 35 U.S.C. 154(b) by 0 days.

(21) Appl. No.: 09/407,410

(22) Filed: Sep. 29, 1999

Related U.S. Application Data

(60) Provisional application No. 60/107,365, filed on Nov. 6, 1998.

(51) Int. Cl.[7] ..... A47B 57/00

(52) U.S. Cl. ..... 248/286.1; 248/918; 248/281.11; 108/7

(58) Field of Search ..... 248/371, 281.11, 248/918, 286.1, 923; 108/7

(56) References Cited

U.S. PATENT DOCUMENTS

| | | | | |
|---|---|---|---|---|
| 4,585,212 | | 4/1986 | Yanker | 254/122 |
| 4,589,621 | | 5/1986 | Hunt et al. | 254/122 |
| 4,616,798 | | 10/1986 | Smeenge et al. | 248/281.1 |
| 4,632,349 | | 12/1986 | Anstey | 248/281.1 |
| 4,790,611 | | 12/1988 | Craner | 312/306 |
| 4,826,123 | | 5/1989 | Hannah et al. | 248/248 |
| 4,843,978 | | 7/1989 | Schmidt et al. | 108/138 |
| 4,988,066 | | 1/1991 | Cotterill | 248/281.1 |
| 5,037,054 | | 8/1991 | McConnell | 248/284 |
| 5,145,136 | | 9/1992 | McConnell | 248/284 |
| 5,257,767 | | 11/1993 | McConnell | 248/284 |
| 5,513,579 | * | 5/1996 | Allen | 248/918 |
| 5,836,560 | * | 11/1998 | Kaplan | 248/918 |
| 5,924,664 | * | 7/1999 | Mileos | 248/281.11 |
| 6,021,985 | * | 2/2000 | Hahn | 248/281.11 |
| 6,027,090 | * | 2/2000 | Liu | 248/286.1 |

FOREIGN PATENT DOCUMENTS

| | | | |
|---|---|---|---|
| 99489 | 6/1923 | (CH) . | |
| 162103 | 8/1933 | (CH) . | |
| 255365 | 1/1949 | (CH) . | |
| 664549 | 10/1984 | (CH) | B66F/3/00 |
| 2535042 | 8/1975 | (DE) | A47B/9/00 |
| 3323780 | 7/1983 | (DE) | A47B/27/04 |
| 0017222 | 4/1980 | (EP) | A47B/27/00 |
| 0256610 | 3/1987 | (EP) | A47B/17/02 |

(List continued on next page.)

OTHER PUBLICATIONS

Industrial Design in Engineering, by Charles H. Flurscheim, 1983.

Industrial Design Magazine's 28th annual review, Published by Design Publications, 1982.

Design of a Three–Degree–of–Freedom Robotic Worktable With Prescribed Entire–Motion Characteristics, by Jau–Jung Chen, Sep. 1986.

*Primary Examiner*—Alvin Chin-Shue
(74) *Attorney, Agent, or Firm*—Banner & Witcoff, Ltd.

(57) ABSTRACT

There is disclosed an adjustable tilt mechanism for a keyboard support platform. The keyboard support platform is of the type that includes a linkage for connecting the platform to a work surface. The linkage further includes connecting arms which pivotally connect the keyboard support platform to the work surface. The adjustable tilt mechanism of the present invention includes a tilt adjustment member that is movable transversely relative to the pivot axis of the platform. Engaging the tilt adjustment member is an angled shaft which is fixed to the platform between the sides of the platform. The tilt adjustment member is also pivotal about a second fixed shaft that is parallel to the pivot axis of the platform. A releasable latching member is mounted on the connecting arms for engaging and releasing the tilt adjustment member. In operation, upon the release of the latching member, slidable movement of the tilt adjustment member alters the pitch of the keyboard support platform, thereby permitting selective adjustment of the work angle of the keyboard.

16 Claims, 6 Drawing Sheets

FOREIGN PATENT DOCUMENTS

| | | | |
|---|---|---|---|
| 0341358 | 5/1988 | (EP) | A61G/7/00 |
| 0405234 | 6/1990 | (EP) | A61B/6/00 |
| 0322994 | 8/1992 | (EP) | G10G/19/44 |
| 0415176 | 5/1995 | (EP) | A61B/6/00 |
| 2517942 | 12/1982 | (FR) | A47B/27/04 |
| 2547195 | 6/1983 | (FR) | A61G/13/00 |
| 47-32098 | 9/1972 | (JP) . | |
| 48-101256 | 12/1973 | (JP) . | |
| 49-1361 | 1/1974 | (JP) . | |
| 49-10887 | 3/1974 | (JP) | A47B/1/02 |
| 4938753 | 4/1974 | (JP) . | |
| 50-17535 | 5/1975 | (JP) | A47C/3/20 |
| 51-90657 | 8/1976 | (JP) | A47C/17/26 |
| 51-148567 | 12/1976 | (JP) | A47C/1/00 |
| 51-151446 | 12/1976 | (JP) | F16M/13/00 |
| 52-30560 | 3/1977 | (JP) | A47C/21/08 |
| 53-93961 | 8/1978 | (JP) | A47C/1/00 |
| 54-127761 | 10/1979 | (JP) | A47C/1/032 |
| 55-119292 | 9/1980 | (JP) | F16M/11/00 |
| 57-69199 | 4/1982 | (JP) | F16M/11/00 |
| 60-44689 | 3/1985 | (JP) | F16M/11/20 |
| 60-146997 | 8/1985 | (JP) | F16M/11/38 |
| 61-136095 | 6/1986 | (JP) | F16M/11/00 |
| 1250694 | 10/1989 | (JP) | F16M/11/38 |
| 7308797 | 8/1916 | (SE) | A61G/13/00 |
| WO8810081 | 12/1988 | (WO) | A47B/9/02 |

* cited by examiner

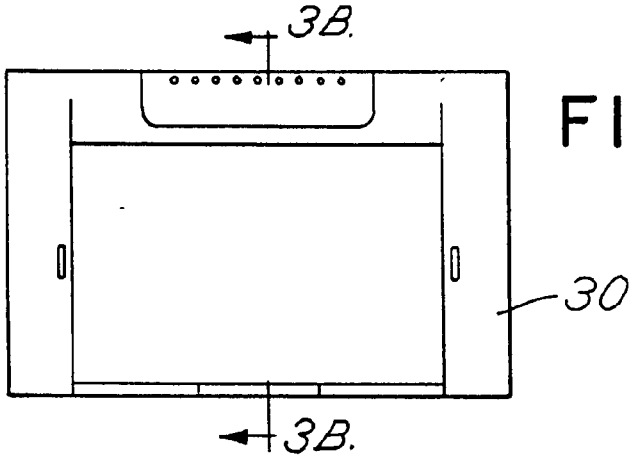
FIG.3A
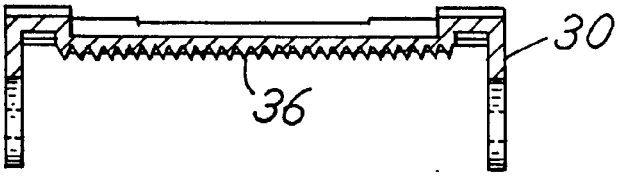
FIG.3C
FIG.3B
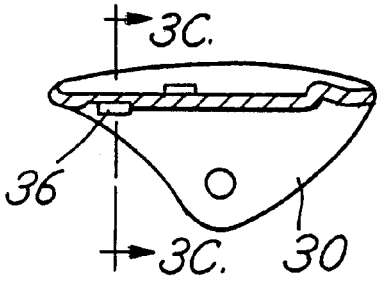
FIG.4A
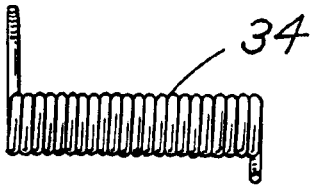
FIG.4B
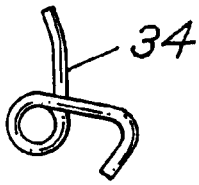

FIG.7B
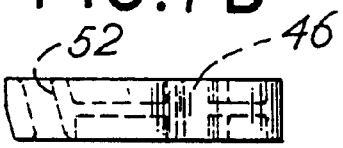
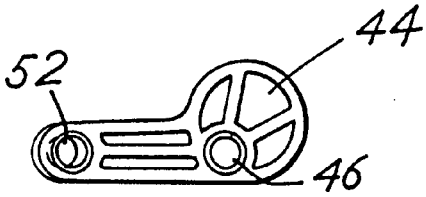
FIG.7A
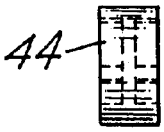
FIG.7C
FIG.8A
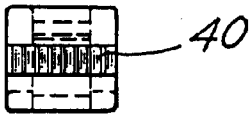
FIG.8B
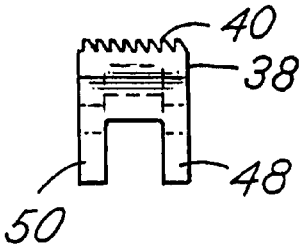
FIG.8C
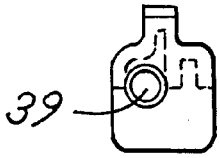
FIG.9A
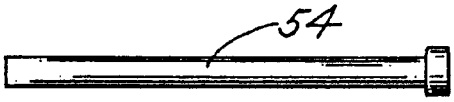
FIG.9B
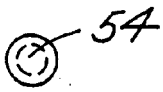

KEYBOARD TILT MECHANISM

This application claims the benefit of U.S. Provisional Application No. 60/107,365, filed Nov. 6, 1998.

BACKGROUND OF THE INVENTION

This invention relates in general to a keyboard support platform assembly and more particularly to an adjustable support platform that permits the adjustment of the pitch or tilt of the support platform to accommodate the setting of the work angle of a keyboard.

The keyboard support platform construction is of the type generally shown in McConnell, U.S. Pat. No. 5,037,054 and U.S. Pat. No. 5,145,136, or Smeenge et al., U.S. Pat. No. 4,616,798. The aforesaid McConnell and Smeenge patents are incorporated herein by reference. As conventional, a keyboard support platform is attached by parallel and/or non-parallel pivotal linkage arms to a slidable plate. The slidable plate, in turn, is mounted in a slide on the underside of a desk or other work surface. The slide permits the keyboard support platform and linkage to move between a retracted or storage position to an extended or use position. The pivotal linkage arms further permit the keyboard support platform to be adjusted to a useful operational work height.

The conventional keyboard support platform assemblies, however, are limited in the degree of keyboard tilt. That is, known keyboard platform assemblies limit the operational work angle of the keyboard and, therefore, do not ergonomically comply with the requirements of all users. Because conventional keyboard support platform assemblies are so limited, keyboard users have suffered from various debilitating medical conditions. As an example, it has been shown that without the proper work angle setting of the keyboard, users who perform considerable data entry on the keyboard have suffered from Carpal Tunnel Syndrome which is a medical disorder of the hand that creates numbness and pain in the fingers. Consequently, there is a need for an improved keyboard support platform assembly which provides not only adjustable work height of the keyboard but also improved adjustment of the tilt or work angle of the keyboard to prevent such debilitating medical conditions.

SUMMARY OF THE INVENTION

The present invention recognizes and provides a solution to the aforementioned problems associated with the known keyboard support platform assemblies. Accordingly, it is an object of the present invention to provide an improved adjustable support mechanism for a keyboard support platform. It is a further object to provide an adjustable tilt mechanism which permits the user to set the pitch of the support platform to accommodate setting of the work angle of a keyboard according to the desires of the user. Yet another object of the invention is to provide a tilt mechanism which also includes an easily adjustable and accessible mechanism for locking or holding the keyboard platform at the desired work angle.

Briefly, in summary, the present invention comprises an adjustable tilt mechanism for a keyboard support platform. The keyboard support platform is of the type that includes a linkage for connecting the platform to a work surface. The linkage further includes connecting arms which pivotally connect the keyboard support platform to the work surface. The adjustable tilt mechanism is pivotally movable about its connection to the connecting arms to permit independent adjustment of the pitch of the platform. The tilt mechanism further includes a tilt adjustment member that is movable transversely relative to the pivot axis of the platform. Engaging the tilt adjustment member is an angled shaft which is fixed to the platform between the sides of the platform. The tilt adjustment member is also pivotal about a second fixed shaft that is parallel to the pivot axis of the platform. A releasable latching member is mounted on the connecting arms for engaging and releasing the tilt adjustment member. In operation, the slidable movement of the tilt adjustment member alters the pitch of the keyboard support platform, thereby setting the work angle of the platform.

The full range of objects, aspects and advantages of the invention are only appreciated by a full reading of this specification and a full understanding of the invention. Therefore, to complete this specification, a detailed description of the invention and the preferred embodiment follows, after a brief description of the drawing.

BRIEF DESCRIPTION OF THE DRAWING

The preferred embodiment of the invention will be described in relation to the accompanying drawing. In the drawing, the following figures have the following general nature:

FIG. 3 is a group of figures depicting a component part of the assembly, namely, the release arm or tilt activating shroud;

FIG. 4 is a spring utilized to maintain the tilt activating shroud of FIG. 3 in position;

FIG. 7 is a group of views of the linear slide link of the assembly;

FIG. 8 is a group of views of the linear guide; and

FIG. 9 is a view of the shaft which is utilized to support the linear slide link and linear guide.

In the accompanying drawing, like reference numerals are used throughout the various figures for identical structures.

DESCRIPTION OF THE PREFERRED EMBODIMENT

Figure 1:
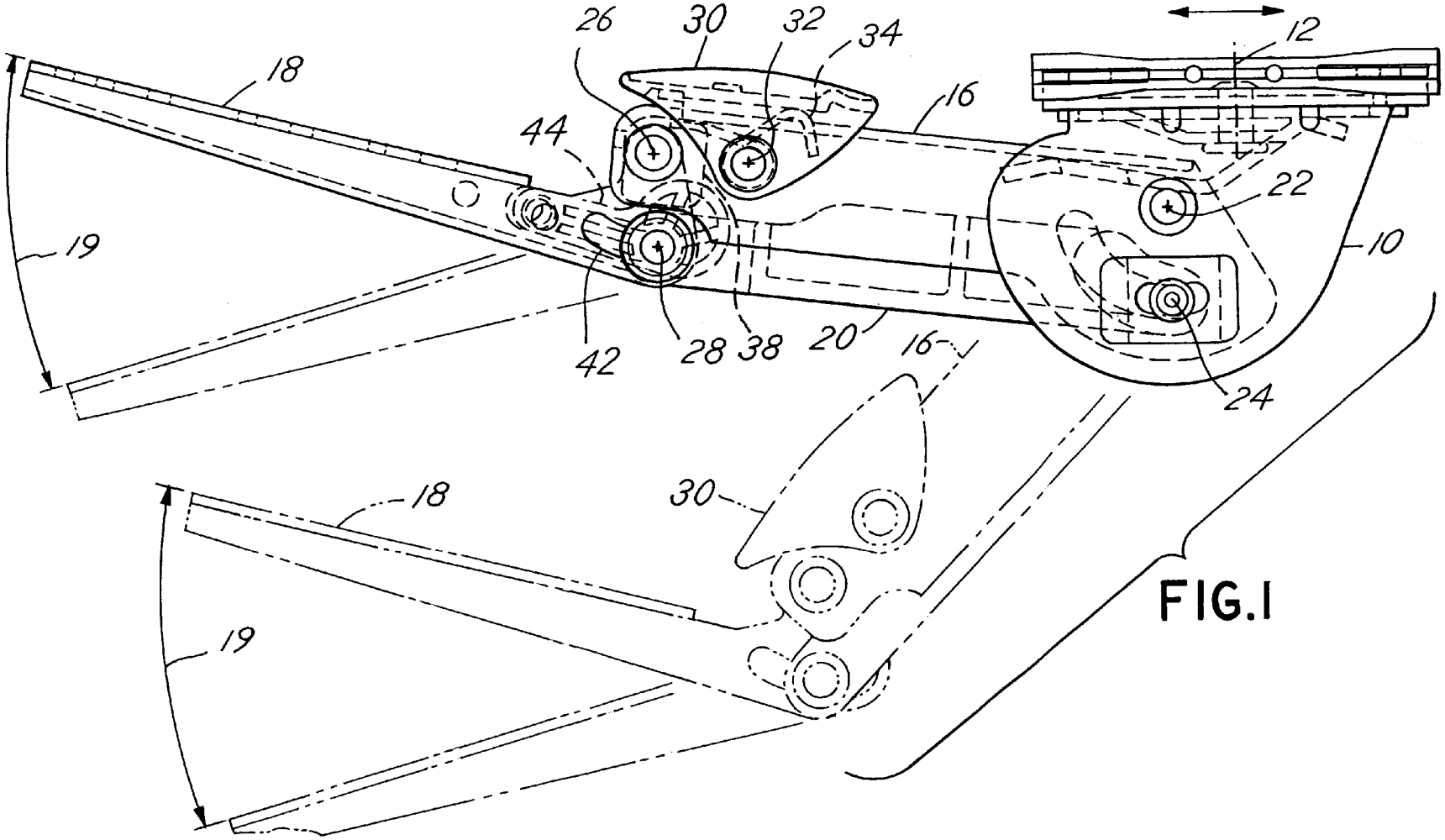
FIG. 1 is a side elevation of the platform pitch adjustment assembly for the keyboard support platform of the invention.
Figure 2:
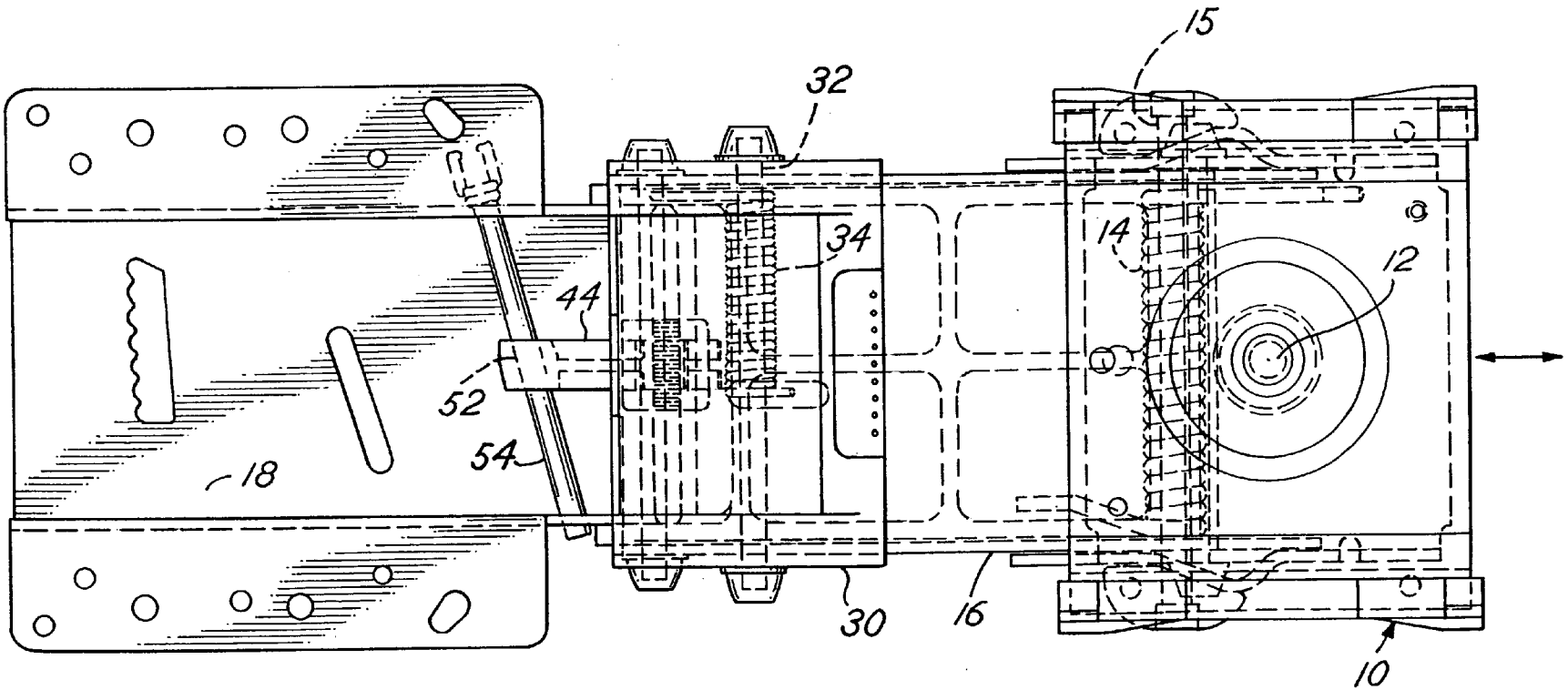
FIG. 2 is a top plan view of the assembly of FIG. 1.
Figure 5A:
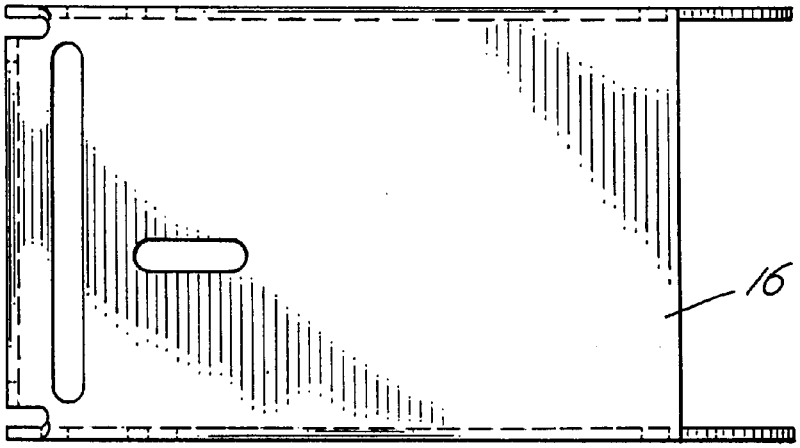
FIG. 5 is a group of views of the outer linkage arm of the assembly.
Figure 5B:
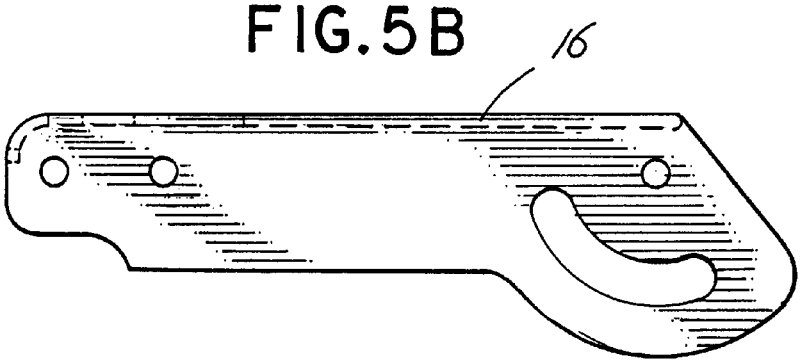
Figure 5C:
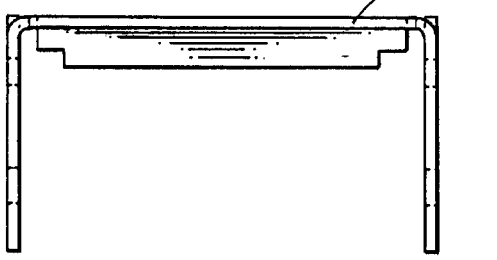
Figure 6A:
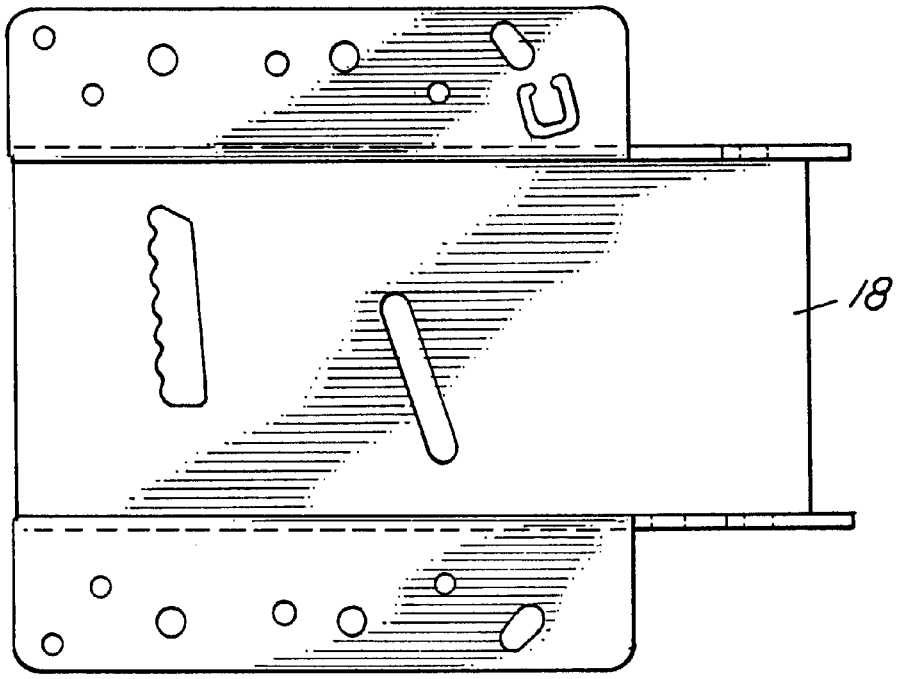
FIG. 6 is a group of views of the platform or front mounting bracket of the assembly.
Figure 6B:
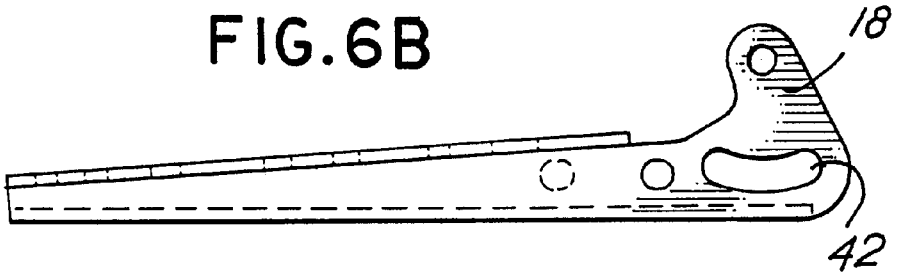
Figure 6C:
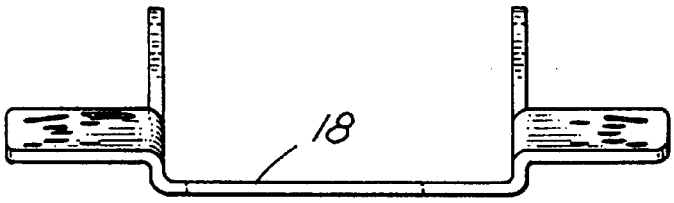

Referring to the figures, there is shown a keyboard support and tilt mechanism of the present invention. The keyboard support mechanism includes a slide bracket assembly 10 which is slidably mounted in a bracket (not shown) that is mounted to the underside of a work surface, desk or platform. Typically, the bracket assembly 10 supports the remainder of the support mechanism and permits sliding movement in the direction depicted by the arrows shown in the figures, particularly FIGS. 1 and 2. As conventional, the bracket assembly 10 is slidable between a retracted position and an extended positions. Additionally, the bracket assembly 10 permits rotational or pivotal movement of the platform about axis 12 as depicted in FIGS. 1 and 2. A spiral spring 14 is provided for engagement with an outer arm or support arm 16 to facilitate support of the weight placed on a platform 18. That is, to assist in supporting the weight placed on the platform 18, one end of the spring 14 is attached to the bracket assembly and the opposite end of the spring 14 biases against the outer arm or support arm 16. The spiral spring 14 fits around a pin 15 defining the axis 22. The pin 15 is capped at both ends.

Pivotally mounted to the bracket assembly 10 are the linkage arms which comprise the outer arm 16 and the connecting arm 20. The linkage arms connect the bracket 10 with the keyboard support platform 18. The outer arm 16 and connecting arm 20 are connected at pivot axis 24 by adjustable fasteners. Pivotally connected at pivot axis 26 by a shaft is the platform 18. The platform 18 includes an arcuate slot 42 which cooperates with a shaft defining the axis 28. Thus, the platform 18 may be pivoted about the axis 26 as limited by the arcuate slot 42. As most preferred, pivot axes or shafts 22, 24, 26 and 28 are parallel to one another. Movement of the platform 18 is therefore effected by movement of the arms 16 and 20 about the axes or shafts 22, 24, 26 and 28.

The subject matter of the present invention relates specifically to the mechanism for adjusting the pitch or tilt of the platform 18. In the embodiment of the invention depicted in FIG. 1, the tilt range, or pitch range 19 is approximately 30° or 15° above a normal horizontal position and 15° below that position. The tilt adjustment mechanism comprises the component parts set forth in FIGS. 3–9 in combination with the aforesaid assembly as described.

Specifically, the tilt mechanism includes a tilt activating shroud or manually actuable lever plate 30 which is pivotally mounted about a pivot axis or shaft 32 biased counterclockwise by a spiral spring 34. Releasably engaged with the plate 30 is a tilt adjustment member of the present invention which permits selective adjustment of the pitch of the keyboard platform. As most preferred, the plate 30 includes a series of teeth 36 which are adapted to engage with the tilt adjustment member and more particularly with the linear guide member 38 of the tilt adjustment member. More specifically, the teeth 36 of the plate 30 engage with the teeth 40 of the guide member 38. The spring 34 fits around the pivot axis or shaft 32. One end of the spring 34 biases against the underside of the tilt activating shroud 30 and the other end of the spring against the underside of the connecting arm 20.

The linear guide member 38 defines an opening 39 which permits the guide member 38 to be slidably mounted on the shaft which defines the axis 26. The linear guide member 38 thus is slidable side to side or laterally on the shaft 26 as described below. The teeth 36 engage with the teeth 40 to lock the guide member 38 into a fixed position in its side to side movement. The linear guide member 38 further defines depending tabs or tangs 48 and 50, more fully described below.

Also mounted on the shaft 28 for side to side movement is a linear slide link 44 of the tilt adjustment member. The linear slide link 44 includes an opening 46 which fits on the shaft defining the axis 28 and thus may move side to side. The linear slide link 44 further engages with the depending tabs or tangs 48 and 50 of the linear guide member 38. The tabs 48 and 50 retain the slide link 44 and thus provide that the guide member 38 will control the movement of the slide link 44 and hold it in position. That is, side to side movement of the guide member 38 moves the slide link 44 from side to side.

As most preferred, the slide link 44 further includes a second passage 52 through which a shaft 54, as shown in FIG. 9, is inserted. The shaft 54 is tilted or angled and extends from one side of the platform 18 to the other side. Depending upon the position of the linear slide link 44 relative to the shaft 54, the pitch or tilt of the platform 18 will vary.

In operation, to adjust the pitch or tilt of the platform 18, an operator will depress the plate or shroud 30 against the force of the spring 34. This releases the teeth 36 from engagement with the teeth 40 of the guide 38. The operator may then manually move the platform 18 upwardly or downwardly as desired. Upon such movement, the linear slide link 44 will slide being driven by the interaction of the shaft 54 with the passage 52. When the platform 18 is set at a desired pitch or tilt, the plate or shroud 30 is released. This permits the teeth 36 of the shroud 30 to be reengaged with the teeth 40 of the guide 38 thus locking the platform 18 in position. It is to be noted that the linear slide link 44 slides on the shaft 28 and simultaneously causes the platform 18 to alter its pitch or tilt due to the interaction of the passage 52 with the tilted or angled shaft 54. The linear guide member 38 follows the travel of the slide link 44 and is finally locked into position as described.

The preferred embodiments of the invention are now described as to enable a person of ordinary skill in the art to make and use the same. Variations of the preferred embodiment are possible without being outside the scope of the present invention. Therefore, to particularly point out and distinctly claim the subject matter regarded as the invention, the following claims conclude the specification.

What is claimed is:

1. In a keyboard support platform of the type including a linkage for connecting the platform to a work surface, the linkage including at least one connecting arm pivotally connecting the platform to the work surface, the improvement comprising:

an adjustable tilt mechanism, the tilt mechanism includes a slide link movable along a fixed shaft on an axis parallel to a pivot axis of the platform, an angled shaft fixed to the platform and engaging the slide link, the slide link also pivotal about a said fixed shaft parallel to the pivot axis of the platform; and a releasable latching member mounted on the at least one connecting arm for engaging and releasing the slide link, whereby the slidable movement of the slide link alters the pitch of the platform.

2. The keyboard support platform of claim 1 wherein the tilt mechanism further comprises a linear guide, the linear guide movable transversely side to side relative to the pivot axis of the platform.

3. The keyboard support platform of claim 2 wherein the linear guide is adapted to receive the slide link and to engage the releasable latching member.

4. The keyboard support platform of claim 1 wherein the releasable latching member is pivotally mounted on the at least one connecting arm.

5. The keyboard support platform of claim 1 wherein the releasable latching member is spring biased on the at least one connecting arm.

6. The keyboard support platform of claim 3 wherein the linear guide defines depending tabs for receiving the slide link.

7. A keyboard support platform assembly mount able to a work surface comprising:

a slide bracket, the slide bracket slidably connected to a work surface, at least one linkage arm pivotally connected to the slide bracket, a platform pivotally mounted to the at least one linkage arm, the platform defining a pivot axis, and an adjustable tilt mechanism connected to the at least one linkage arm and the platform, the tilt mechanism includes a slide link movable along a a fixed shaft on an axis parallel to the pivot axis of the platform, an angled shaft fixed to the platform and engaging the slide link, the slide link also pivotal about said fixed shaft parallel to the pivot axis of the platform, whereby the slidable movement of the slide link alters the pitch of the platform.

8. The keyboard support platform assembly of claim 7 further comprising a releasable latching member mounted on the at least one linkage for engaging and releasing the slide link.

9. The keyboard support platform assembly of claim 8 wherein the tilt mechanism further comprises a linear guide, the linear guide movable transversely side to side relative to the pivot axis of the platform.

10. The keyboard support platform assembly of claim 9 wherein the linear guide is adapted to receive the slide link and to engage the releasable latching member.

11. The keyboard support platform assembly of claim 8 wherein the releasable latching member is spring biased on the at least one connecting arm.

12. The keyboard support platform assembly of claim 10 wherein the linear guide defines depending tabs for receiving the slide link.

13. The keyboard support platform assembly of claim 7 wherein the platform defines an arcuate slot on opposing sides of the platform for receiving said second fixed shaft.

14. In a keyboard support platform of the type including a linkage for connecting the platform to a work surface, the linkage including connecting arms pivotally connecting the platform to the work surface, the arms pivoted about parallel axes, the platform being pivotally movable about its connection to the connecting arms to independently adjust the pitch of the platform with respect thereto, the improvement comprising:

an adjustable tilt mechanism mounted to the connecting arms and the platform, the adjustable tilt mechanism further comprising a platform interactive member slidable along a axis parallel to the a pivot axis of the, platform, whereby slidable movement of the platform interactive member alters the pitch of the platform; and a releasable latching member mounted on the connecting arms for engaging and releasing the platform interactive member, wherein the platform interactive member comprises a linear guide and a linear slide link operatively received in the linear guide, and the linear guide defines depending tabs for operatively receiving the slide link.

15. The keyboard support member of claim 14 further comprising an angled shaft fixed to the platform and engaging the slide link.

16. The keyboard support member of claim 15 wherein the slide link is pivotal about a second fixed shaft on said axis parallel to said pivot axis.

* * * * *